US005354171A

United States Patent [19]

Mercede, Jr.

[11] Patent Number: 5,354,171

[45] Date of Patent: Oct. 11, 1994

[54] METHOD AND APPARATUS FOR REVERSE ACCUMULATION OF FOLDED DOCUMENTS

[75] Inventor: John J. Mercede, Jr., Easton, Conn.

[73] Assignee: Pitney Bowes Inc., Stamford, Conn.

[21] Appl. No.: 140,807

[22] Filed: Oct. 21, 1993

[51] Int. Cl.[5] ..... B65G 57/00

[52] U.S. Cl. ..... 414/790.2; 414/790.7; 414/795; 271/212

[58] Field of Search ..... 271/177, 181, 212, 213, 271/272, 306; 414/789.9, 790.2, 790.7, 790.8, 794.9, 795

[56] References Cited

U.S. PATENT DOCUMENTS

| | | | |
|---|---|---|---|
| 3,744,649 | 7/1973 | Ward, Jr. | 271/212 X |
| 3,871,539 | 3/1975 | Nikkel | 271/212 X |
| 4,143,981 | 3/1979 | Hansen et al. | 400/628 |
| 4,425,068 | 1/1984 | Wilson et al. | 414/794.9 X |
| 4,500,244 | 2/1985 | Sardella et al. | 414/794.9 |
| 4,511,301 | 4/1985 | Kawano et al. | 271/213 X |
| 4,640,506 | 2/1987 | Luperti | 271/212 |
| 4,799,663 | 1/1989 | Golicz | 271/199 |
| 4,805,891 | 2/1989 | Luperti et al. | 271/212 |
| 4,925,180 | 5/1990 | Golicz | 271/198 |

FOREIGN PATENT DOCUMENTS

| | | | |
|---|---|---|---|
| 48357 | 5/1981 | Japan | 271/306 |

*Primary Examiner*—Robert P. Olszewski
*Assistant Examiner*—Boris Milef
*Attorney, Agent, or Firm*—Charles R. Malandra, Jr.; Melvin J. Scolnick

[57] ABSTRACT

A method and apparatus for reverse accumulation of folded documents. The apparatus includes: a device for feeding folded documents seriatim along a path of travel; an entrance deck adjacent and downstream of the feeding device for receiving the folded documents from the feeding device, the entrance deck forming an angle with the path of travel between 5 and 10 degrees; an accumulation deck extending downwardly from the entrance deck, the accumulation deck forming an angle between 25 and 35 degrees with respect to the entrance deck; a curved deflector situated above the entrance deck for guiding the folded documents onto the entrance deck; a pair of pinch roller situated downstream of the accumulation deck for receiving a plurality of folded documents in the same order as the folded documents are fed by the feeding device, wherein the length of the accumulation deck is between 75% and 85% of the length of the folded documents; the means for cylically driving the pinch rollers to feed an accumulation of folded documents away from the pinch rollers.

13 Claims, 4 Drawing Sheets 10
14
12
12
18
22
34
16
20
24
36
40
42
32
26
38
28

METHOD AND APPARATUS FOR REVERSE ACCUMULATION OF FOLDED DOCUMENTS

BACKGROUND OF THE INVENTION

The instant invention relates to a method and apparatus for accumulating documents, and more particularly to such a method and apparatus in which the documents being accumulated are not flat sheets but rather are folded sheets of paper.

Accumulating devices are frequently used in line with other paper handling equipment, such as folders and bursters, as a means of assembling a plurality of sheets of paper into a particular, desired packet prior to further processing, which may include additional collating, folding and inserting. For further background, reference can be made to U.S. Pat. Nos. 4,143,981 and 4,640,506.

When documents are fed from a burster or a folder and accumulated for further processing, typically the first sheet to emerge from the burster or folder becomes the bottom sheet of a stack, and each subsequent sheet is laid on top of the preceding sheet; in other words, the usual method of accumulating documents results in the documents being stacked in an opposite order in which they are fed. There is ample prior art which discloses devices for accumulating documents in the same order in which they are fed, which the art refers to as reverse accumulation.

When the documents being accumulated are not single sheets but instead are folded, the currently available accumulators are only able to accumulate the folded documents by placing each succeeding folded sheet seriatim over each preceding folded sheet, so that the normal accumulation is in opposite order from the order of feeding. There are many applications in which it is desirable to accumulate folded documents in the same order in which they are fed, which the art refers to as reverse accumulation. Accordingly, the instant invention provides a method and apparatus for reverse accumulating a plurality of folded documents.

SUMMARY OF THE INVENTION

The instant invention therefore provides apparatus for reverse accumulation of folded documents, which includes: a device for feeding folded documents seriatim along a path of travel; an entrance deck adjacent and downstream of the feeding device for receiving the folded documents from the feeding device, the entrance deck forming an angle with the path of travel between 5 and 10 degrees; an accumulation deck extending downwardly from the entrance deck, the accumulation deck forming an angle between 25 and 35 degrees with respect to the entrance deck; a curved deflector situated above the entrance deck for guiding the folded documents onto the entrance deck; a pair of pinch roller situated downstream of the accumulation deck for receiving a plurality of folded documents in the same order as the folded documents are fed by the feeding device, wherein the length of the accumulation deck is between 75% and 85% of the length of the folded documents; and means for cylically driving the pinch rollers to feed an accumulation of folded documents away from the pinch rollers.

DETAILED DESCRIPTION OF THE PREFERRED EMBODIMENT

Figure 1:
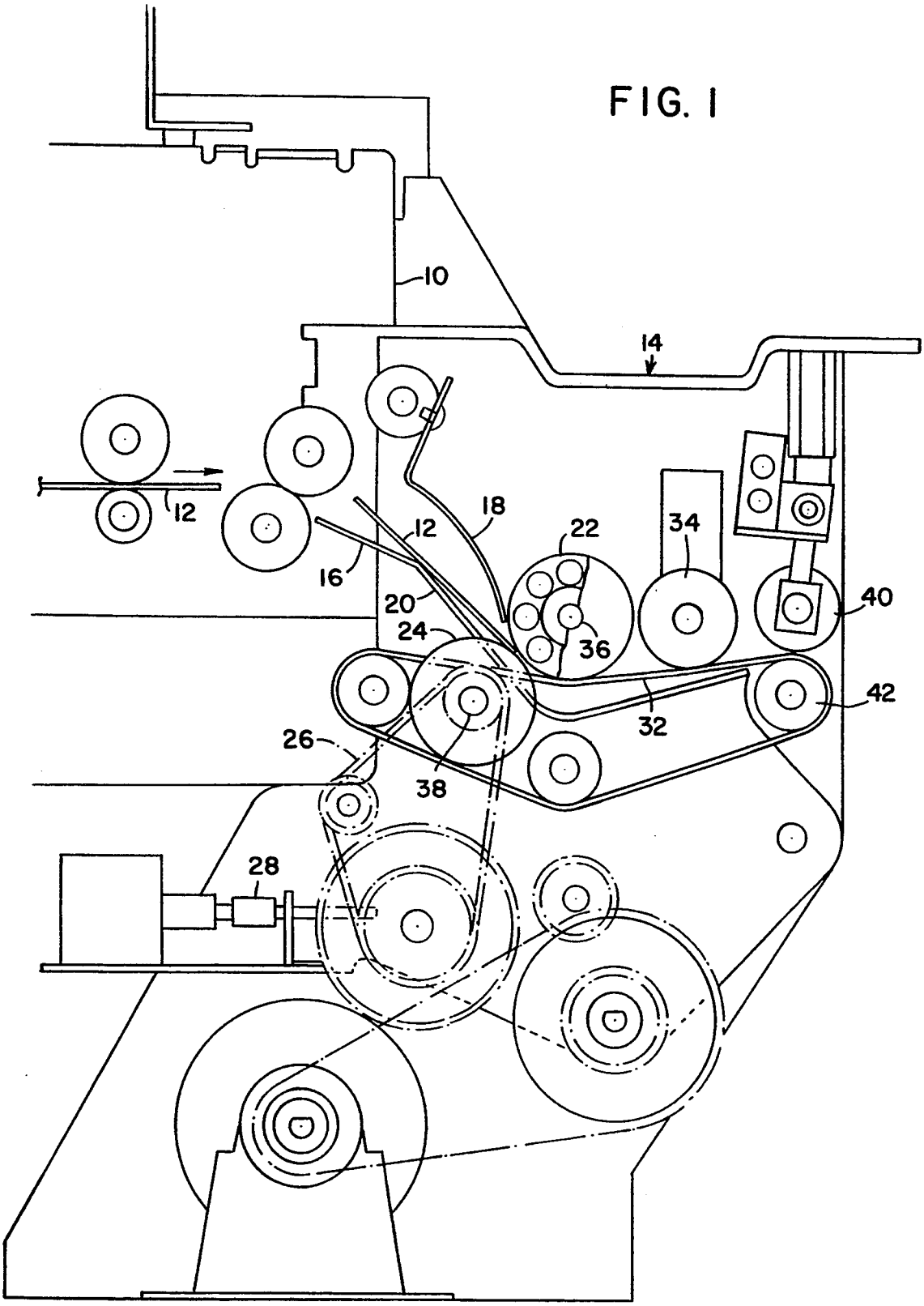
FIG. 1 is a side, elevational view of a reverse accumulator for folding documents in accordance with the instant invention.

In describing the preferred embodiment of the instant invention, reference is made to the drawings wherein there is seen a bursting and folding module generally designated 10 which bursts and folds paper documents 12 in conventional manner and then feeds the folded document 12 toward a reverse accumulator module generally designated 14.

The reverse accumulator 14 includes an entrance deck 16 for receiving the folded documents 12 from the burster-folder 10. The documents 12 have the fold at the leading edge and are guided onto the entrance deck 16 by a curved deflector 18. The angle of the entrance deck 16 is critical to the successful functioning of the reverse accumulator 14. The angle a of the entrance deck 16 with respect to the plane 31 defined by the path of paper travel should be between 5 and 10 degrees. For most applications, the preferred angle is about 6 degrees.

The curved deflector 18 is located above the entrance deck 16 and has a curve which is concave with respect to the deck 16. Extending from the entrance deck 16 and inclined with respect thereto is an accumulation deck 20 which leads to a pair of pinch roller 22 and 24. The angle b of the accumulation deck 20 with respect to the entrance deck 16 should be between 25 and 35 degrees, with the preferred range being between 28 and 32 degrees. For most applications, the preferred angle b is about 30 degrees. As the folded documents are fed from the burster-folder 10 into the accumulator 14, they are directed by the curved deflector 18 into the pinch created by the pair of rollers 22 and 24.

Figure 2:
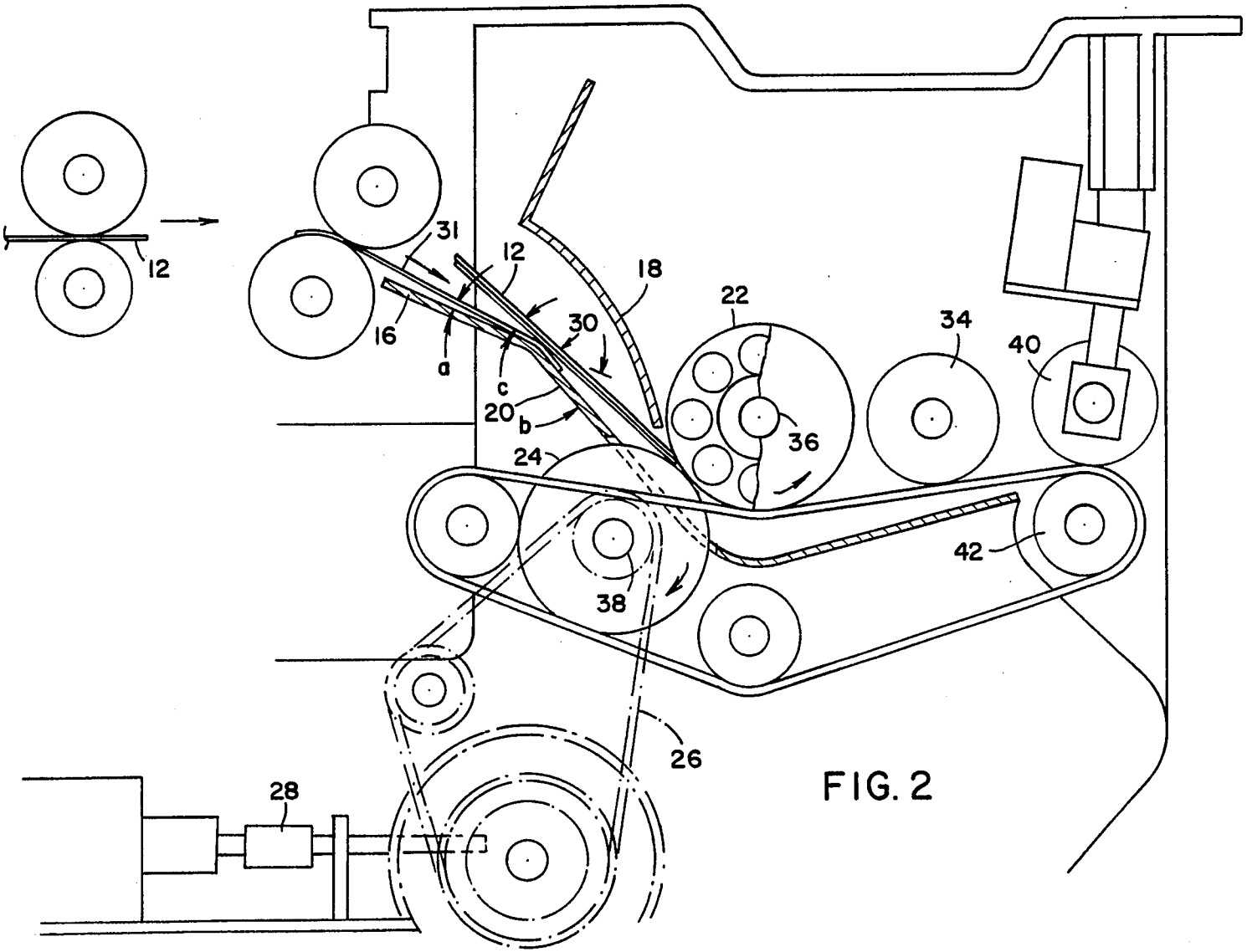
FIG. 2 is an enlarged, side elevational view of the accumulating station seen in FIG. 1.

The pinch rollers 22 and 24 should be positioned such that the length of the accumulation deck 20 is between 75% and 85% of the length of the document 12. The preferred range for the length of the accumulation deck 20 is between 80% and 85% of the length of the document 12, with 85% being the preferred length for most applications. The described angles a and b, the curved deflector 18 and the position of the pinch rollers 22 and 24 cause the folded documents 12 to stand up at an angle c (see FIG. 2) with respect to the paper travel plane 31 which allows the next folded document 12 to accumulate underneath.

Figure 3:
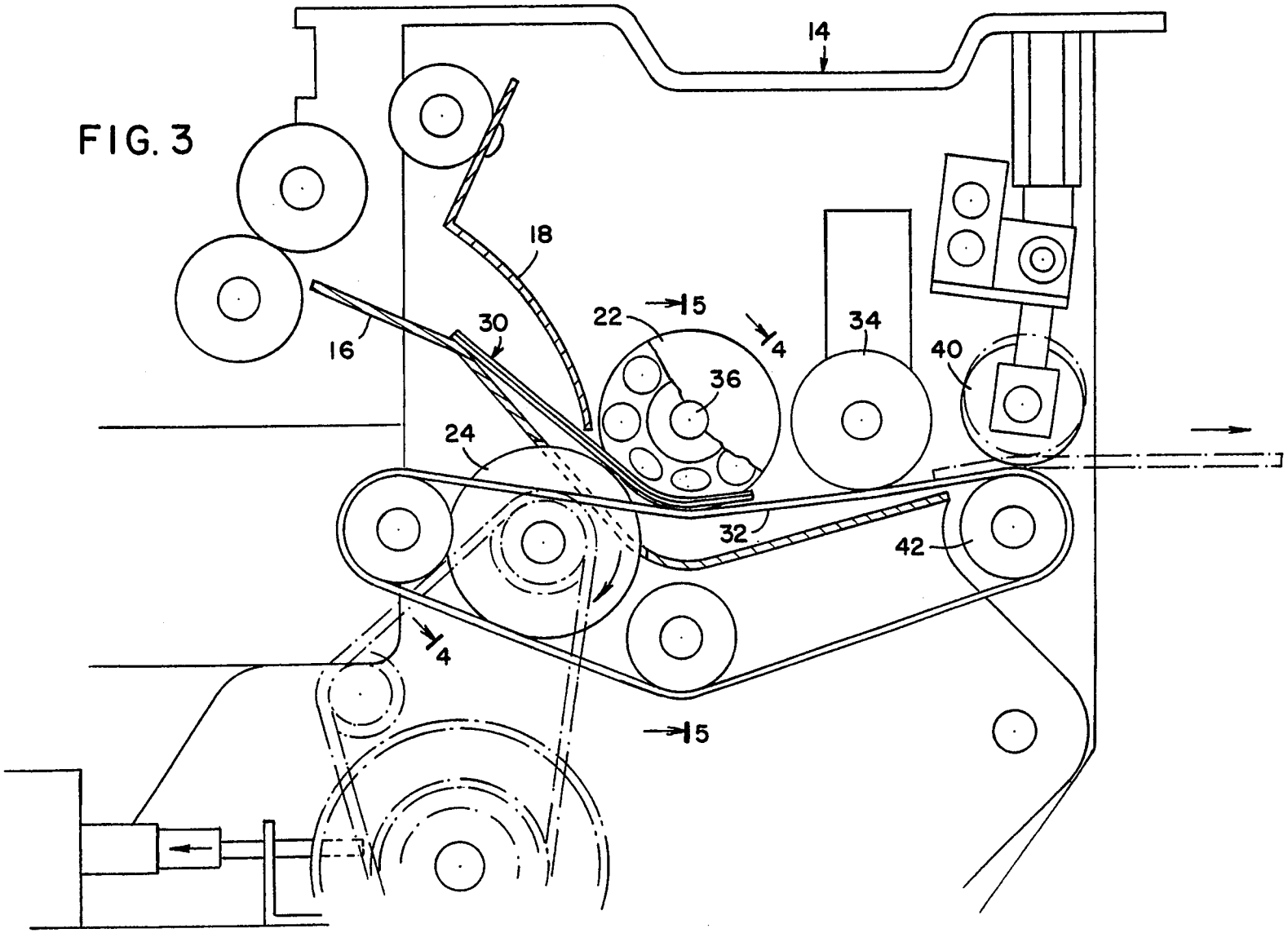
FIG. 3 is similar to FIG. 1 but shows the collation of documents being advanced by a pair of feed rollers.
Figure 4:
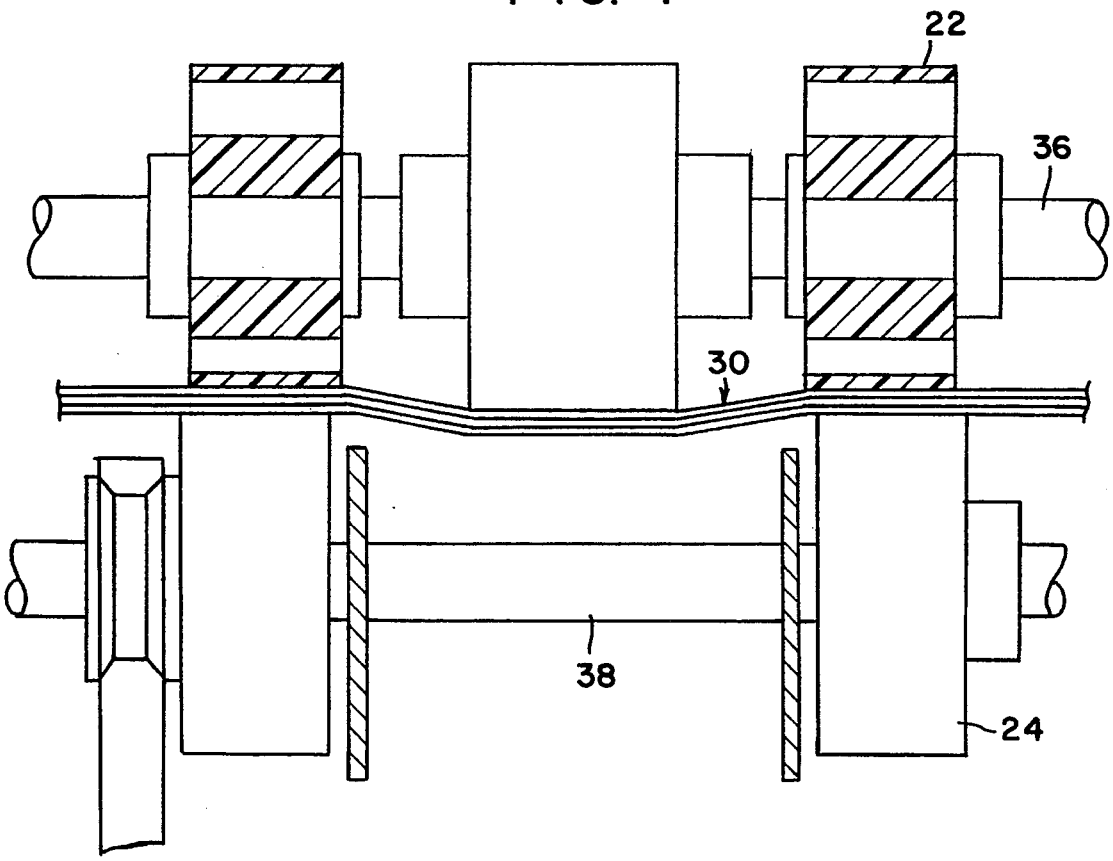
FIG. 4 is a sectional view taken on the plane indicated by the line 4—4 in FIG. 3.
Figure 5:
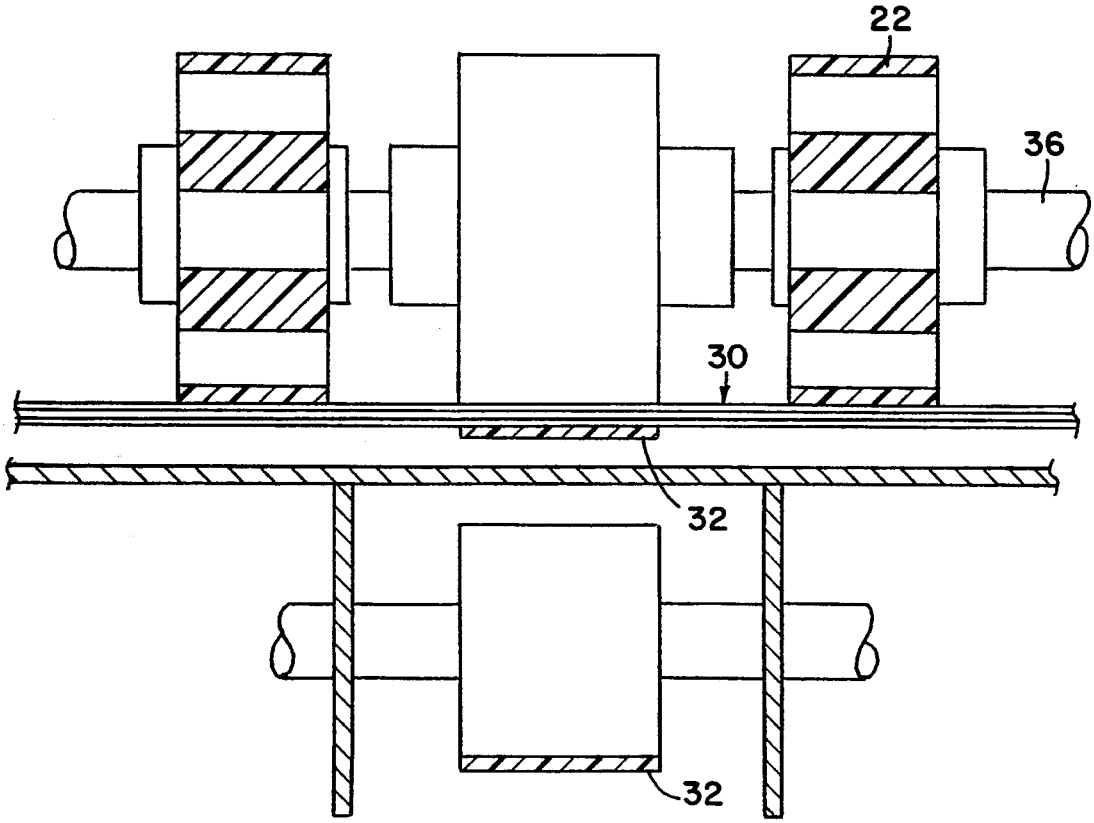
FIG. 5 is a sectional view taken on the plane indicated by the line 5—5 in FIG. 3.

When a complete collation 30 is accumulated at the pinch rollers 22 and 24, a drive belt 26 is engaged by a one cycle clutch mechanism 28 and the pinch rollers 22 and 24 are driven to drive the collation 30 (see FIG. 3) into the nip of an accelerator belt 32 and an idler roller 34. The pinch rollers 22 and 24 are geared together on fixed parallel shafts 36 and 38 respectively with the upper roller 22 compliant enough to pass a collation thickness of 0.4 inches. The continuously moving accelerator belt 32 carries the reverse collated set of documents 30 into the exit rollers 40 and 42, after which the collation 30 is set onto a conveyor.

It should be understood by those skilled in the art that various modifications may be made in the present invention without departing from the spirit and scope thereof, as described in the specification and defined in the appended claims.

What is claimed is:

1. Apparatus for reverse accumulation of folded documents, comprising:

means for feeding folded documents seriatim along a path of travel;

an entrance deck adjacent and downstream of said feeding means for receiving said folded documents from said feeding means, said entrance deck forming an angle with said path of travel between 5 and 10 degrees;

an accumulation deck extending downwardly from said entrance deck, said accumulation deck forming an angle between 25 and 35 degrees with respect to said entrance deck;

a curved deflector situated above said entrance deck for guiding said folded documents onto said entrance deck;

a pair of pinch rollers situated downstream of said accumulation deck for receiving a plurality of folded documents in the same order as said folded documents are fed by said feeding means, wherein the length of said accumulation deck is between 75% and 85% of the length of said folded documents; and means for cyclically driving said pinch rollers to feed an accumulation of folded documents away from said pinch rollers.

2. The apparatus of claim 1, wherein the entrance deck forms an angle of about 6 degrees with said path of travel.

3. The apparatus of claim 2, wherein said accumulation deck forms an angle between 28 and 32 degrees with respect to said entrance deck.

4. The apparatus of claim 3, wherein the accumulation deck is between 80% and 85% of the length of the folded documents.

5. The apparatus of claim 4, wherein said accumulation deck forms an angle of about 30 degrees with respect to said entrance deck.

6. The apparatus of claim 5, wherein the accumulation deck is about 85% of the length of the folded documents.

7. The apparatus of claim 6, wherein said cyclical drive means includes a one way clutch and a drive belt engaged by said one way clutch.

8. A method for reverse accumulating folded documents, comprising:

feeding folded documents seriatim along a path of travel;

further feeding said folded documents downwardly onto an entrance deck adjacent and downstream of said path of travel;

deflecting said folded documents onto an accumulation deck extending downwardly from said entrance deck;

accumulating said folded documents at the nip of a pair of pinch rollers situated downstream of said accumulation deck; and cyclically rotating said pinch rollers to feed said accumulated documents away from said pinch rollers, wherein said entrance deck forms an angle between 5 and 10 degrees with said path of travel, said accumulation deck forms an angle between 25 and 35 degrees with respect to said entrance deck, and the length of said accumulation deck is between 75% and 85% of the length of said folded documents.

9. The method of claim 8, wherein the entrance deck forms an angle of about 6 degrees with said path of travel.

10. The method of claim 9, wherein said accumulation deck forms an angle between 28 and 32 degrees with respect to said entrance deck.

11. The method of claim 10, wherein the accumulation deck is between 80% and 85% of the length of the folded documents.

12. The method of claim 11, wherein said accumulation deck forms an angle of about 30 degrees with respect to said entrance deck.

13. The method of claim 12, wherein the accumulation deck is about 85% of the length of the folded documents.

* * * * *